United States Patent [19]

Bauer

[11] Patent Number: 5,064,021

[45] Date of Patent: Nov. 12, 1991

[54] WINDOW ESCAPE

[76] Inventor: Ronald F. Bauer, 245 Shelly Dr., Sheboygan Falls, Wis. 53085

[21] Appl. No.: 512,172

[22] Filed: Apr. 20, 1990

[51] Int. Cl.[5] ..... A62B 1/16

[52] U.S. Cl. ..... 182/73; 182/100; 182/190

[58] Field of Search ..... 182/73, 76, 78, 190, 182/74

[56] References Cited

U.S. PATENT DOCUMENTS

| | | | |
|---|---|---|---|
| 277,175 | 5/1883 | Trafton | 182/73 |
| 282,212 | 7/1883 | Murdock . | |
| 283,439 | 8/1883 | Torst . | |
| 285,806 | 10/1883 | Foster . | |
| 289,286 | 11/1883 | Margileth | 182/73 |
| 292,531 | 1/1884 | Bartlett | 182/73 |
| 319,824 | 6/1885 | Kimmell | 182/73 |
| 335,372 | 2/1886 | Marcus . | |
| 831,808 | 9/1906 | Thompson . | |
| 1,236,621 | 8/1917 | Strenyo | 182/73 |
| 3,750,843 | 8/1973 | Wilhelm . | |

FOREIGN PATENT DOCUMENTS

| | | | |
|---|---|---|---|
| 432983 | 10/1911 | France | 182/173 |

*Primary Examiner*—Reinaldo P. Machado
*Attorney, Agent, or Firm*—Donald Cayen

[57] ABSTRACT

A window escape comprises a sturdy housing secured to a building wall above a window or the like. The housing has an open bottom and a rotatable sleeve supported between two side walls. A cover is removably retained over the front of the housing. A long rope is tied at one end to the sleeve and at the other end to the cover. Normally the rope is wound around the sleeve and is hidden from view by the cover. In an emergency, a person removes the cover from the housing and throws the cover out the open window. The falling cover unwinds the rope from the sleeve. After the rope is unwound, the person can easily grasp it and descend to safety.

3 Claims, 2 Drawing Sheets

WINDOW ESCAPE

BACKGROUND OF THE INVENTION

1. Field of the Invention.

This invention pertains to safety devices, and more particularly to apparatus for enabling a person to escape from a building.

2. Description of the Prior Art.

Various equipment has been developed that provides a means of escape from a burning room or similar dangerous location. For example, it is known to use rope ladders and the like to descend from the upper stories of a building during emergency conditions.

U.S. Pat. No. 335,372 shows a fire escape in the form of a rope ladder. Other rope-type escape devices are shown in U.S. Pat. Nos. 282,212; 283,439; 285,806; 289,286; 831,808; and 3,750,843.

The various escapes of the foregoing patents have certain disadvantages. The escapes of the U.S. Pat. Nos. 282,212 and 289,286 patents, for instance, are difficult to use by women and children, because the users must support themselves by their hands and arms from a rope trained over a pulley.

The ropes of the U.S. Pat. Nos. 283,439; 285,806; and 335,372 patents hang over the sills of the escape windows. That design makes it awkward and difficult for a person to use, because the person must crawl out the window feet first and balance on the window sill while trying to grasp the rope at their knees. Moreover, since the rope is in overlying contact with the sill, users have difficulty in quickly wrapping their hands around the rope in a firm grip.

The fire escape of the 831,808 patent includes a rope that is freely coiled inside a case. The rope must be coiled with great care so that it does not knot when the case is thrown out the window during an emergency.

The fire escape of the U.S. Pat. No. 3,750,843 patent is rather complicated. It includes a control rope that a person must operate to regulate the speed of the descent rope that supports the person.

Thus, a need exists for an improved safety escape.

SUMMARY OF THE INVENTION

In accordance with the present invention, a practicable and reliable window escape is provided that requires minimum time and effort to place into use. This is accomplished by apparatus that includes a strong rope having one end tied to a rotatable sleeve and the other end attached to a housing cover.

The housing is firmly secured to a building wall above a window or other opening. The housing preferably has top, back, and side walls fixed to each other; the back wall is secured to the building. The housing front is selectively covered by a removable cover. The cover may be held in place on the housing with the magnets. The cover preferably has a large knob for easy and quick gripping. The housing bottom is open. The housing and cover may be made of wood and finished to present a very attractive appearance.

Extending between and supported by the two side walls of the housing is a spindle. A sleeve is freely rotatable about the spindle. The length of the sleeve is slightly less than the distance between the two housing side walls. Tied to the sleeve is one end of the rope. The rope is neatly and carefully wound around the sleeve entirely inside the housing. The second end of the rope is attached to the inside of the housing cover.

Normally, the window escape appears as an unobtrusive and attractive fixture secured to the building wall above a window. In emergency situations, however, the window escape is immediately deployable into a potentially life saving device. The window escape is used merely by opening the window, pulling the front cover from the housing, and throwing the cover out the window. The weight of the falling cover pulls the rope to rotate the sleeve and unwind the rope from the sleeve. The unwound rope hangs vertically from top to bottom across the window opening. The rope is thus freely accessible for convenient grasping and descending to safety.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
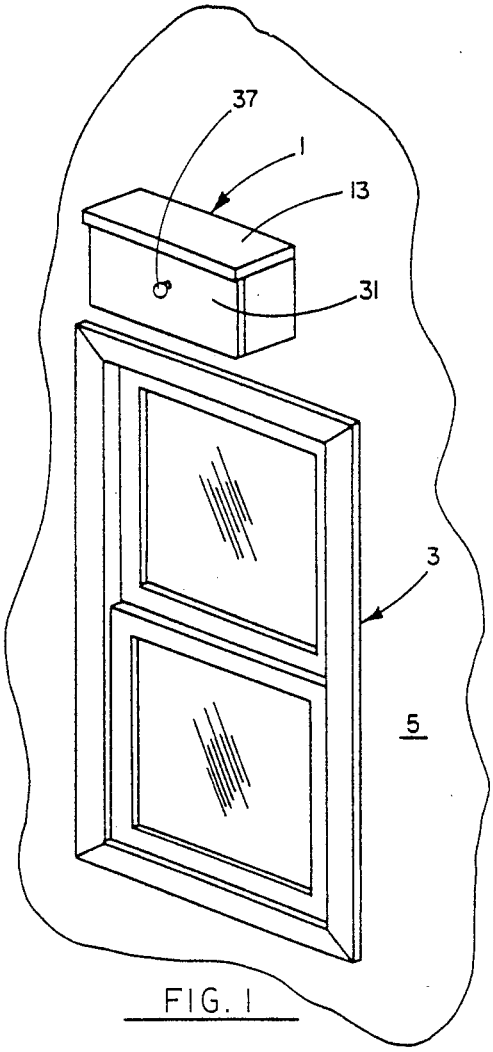
FIG. 1 is a perspective view of the window escape of the present invention in place over a window.

Referring to FIG. 1, a window escape 1 is illustrated that includes the present invention. The window escape is particularly useful for enabling a person to escape through a window 3 of a building 5, but it will be understood that the invention is not limited to emergency exit applications.

Figure 2:
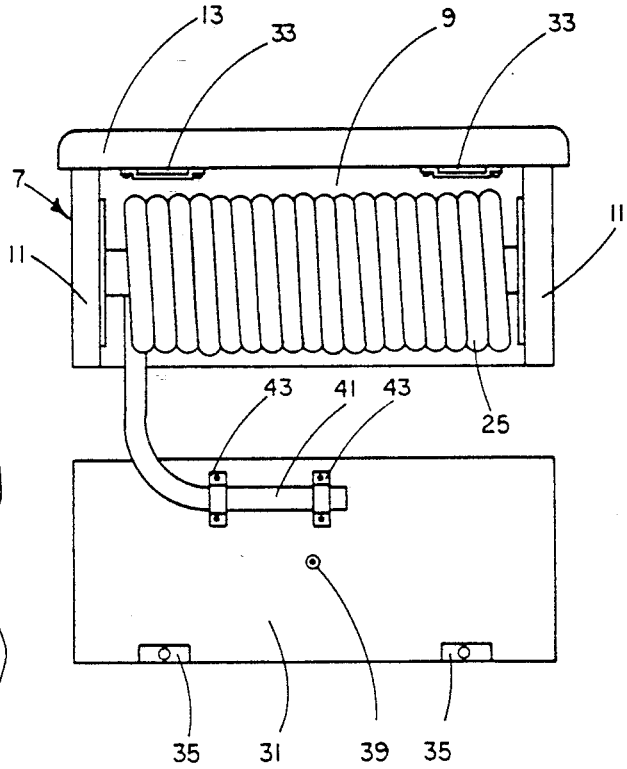
FIG. 2 is a front view on an enlarged scale of the present invention with the cover removed.
Figure 3:
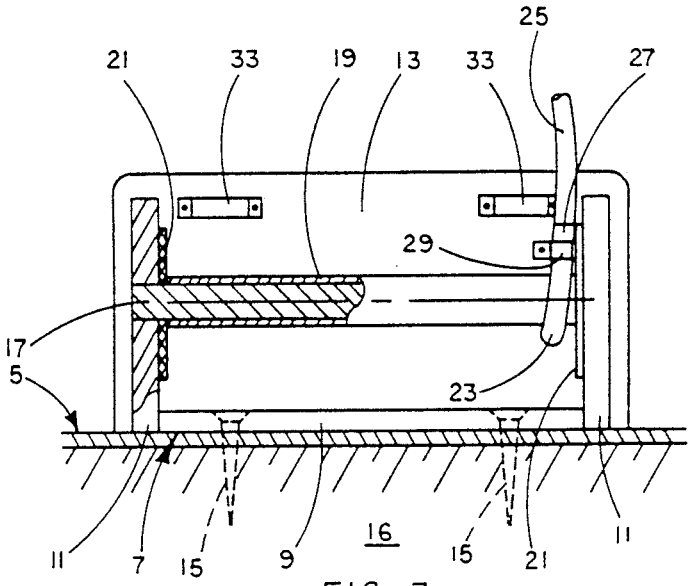
FIG. 3 is a bottom view on an enlarged scale of the window escape with the cover removed and the rope unwound.
Figure 4:
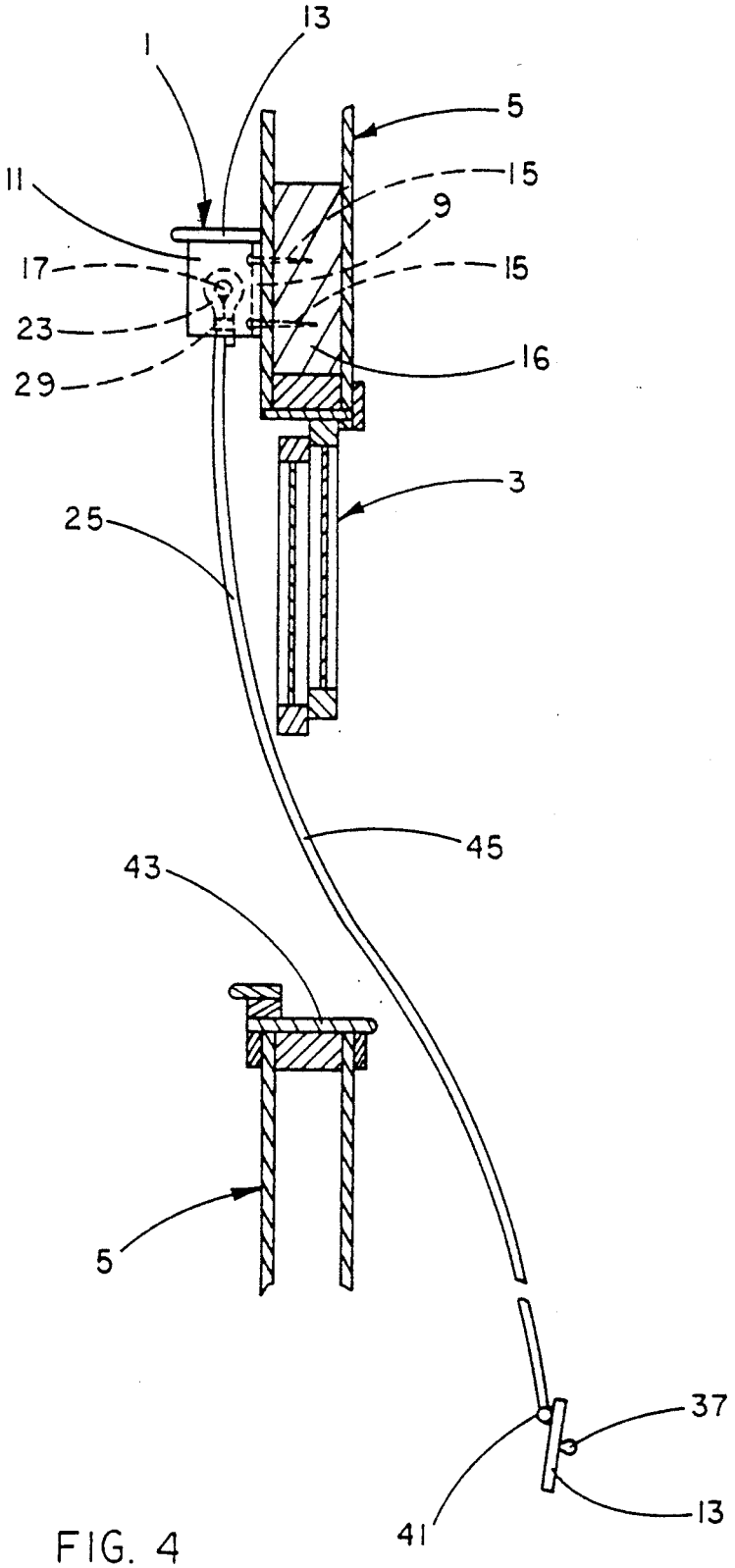
FIG. 4 is a side view, partially in section, of the invention in use.

Looking also at FIGS. 2 and 3, the window escape 1 is comprised of a sturdy housing 7 that has four walls: a back wall 9, two opposed side walls 11, and a top wall 13. The back wall 9 is firmly secured to the inside of the building wall 5 by long screws 15. The screws 15 are firmly embedded in the window header 16.

Supported in and extending between the housing side walls 11 is a spindle 17. A sleeve 19 is placed over and is freely rotatable about the spindle 17. Preferably, a thin washer 21 is interposed between each end of the sleeve 19 and the corresponding housing side wall.

Tied to the sleeve 19 is one end 23 of a long rope 25. The rope end 23 may be tied to the sleeve in any suitable manner. However, I prefer that the rope end 23 be looped around the sleeve and the rope free end 27 be clamped to the rope standing end by a hose or similar clamp 29.

The rope 25 may be as long as desired, depending upon the height of the window 3 above the ground outside the building. The rope is wound around the sleeve 19. Because the sleeve freely rotates on the spindle 17, the rope may be very easily and neatly wound in as many layers as necessary.

The front side of the housing 7 is covered by a removable front cover 31. The cover 31 is removably retained on the housing by means that enable the cover to be quickly removed from the housing, as will be explained hereinafter. In the illustrated construction, retention of the cover on the housing is by magnets 33 fastened to the housing top wall 13 and ferrous plates 35 fastened to the cover. To easily manipulate the cover, a handle or knob 37 is joined to the cover, as by a long screw 39.

Further in accordance with the present invention, the second free end 41 of the rope 25 is attached to the cover 31. Attachment may be by one or more clips 43. Normally, the rope is fully wound on the spindle 19, the cover is retained neatly in place on the housing 7 by the magnets 33 and plates 35, and the rope is hidden from view. The housing side and top walls 11 and 13, respectively, and the cover 31 may be made from finished wood, such as oak or walnut. With the cover in place, the window escape 1 presents a very attractive appearance.

To use the window escape 1 in an emergency situation, a person need only open the window 3, pull the cover from the housing 7 by means of the knob 37, and throw the cover out the window. As the cover falls by gravity, it pulls the rope 23 to unwind it from the rotating sleeve 19. When the rope is fully unwound, the person steps or crawls feet first out the open window and stands or kneels on the sill 43. In that position, the rope is vertically in front of the person, and it is freely accessible for immediate grasping in the region 45. With no obstructions around the rope, as from the sill 43, the person is able to quickly grasp the rope and then descend to safety.

Thus, it is apparent that there has been provided, in accordance with the invention, a window escape that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A window escape comprising:

a. a housing having a back wall, opposed side walls, and an open bottom;

b. sleeve means extending between and rotatably supported by the housing side walls;

c. a cover removably retained on opposite the back wall; and d. an elongated rope having a first end tied to the sleeve means and a second end attached to the cover, the rope intermediate the first and second ends being wound on the sleeve means and stored inside the housing when the cover is retained on the housing, so that the cover can be quickly removed from the housing to thereby unwind the rope from the sleeve means with the rope passing through the housing open bottom.

2. The window escape of claim 1 wherein the sleeve means comprises:

a. a spindle supported in the housing side walls; and b. a sleeve rotatable on the spindle, the rope first end being tied around the sleeve and the rope being selectively windable around the sleeve.

3. Apparatus for assisting a person escape from a through an opening therein comprising:

a. a housing comprising:

i. a back wall firmly secured to the building wall above the opening therein;

ii. a pair of side walls joined to the back wall; and iii. a top wall secured to the back and side walls;

b. a cover removably retained opposite the back wall, the housing having an open bottom;

c. sleeve means rotatably supported in the housing side walls; and d. an elongated rope having a first end tied to the sleeve means and being selectively windable thereon and a second end attached to the cover, so that the rope may be selectively wound on the sleeve means inside the housing and the cover retained on the housing to hide the rope from view and in an emergency situation the cover is removable from the housing to be thrown out the building opening to thereby pull the rope and unwind it from the sleeve means to present an escape rope for the person to descend.

* * * * *